United States Patent [19]

Farrar

[11] 4,188,825

[45] Feb. 19, 1980

[54] MONITOR FOR DIVERS TO AVOID DECOMPRESSION

[76] Inventor: James G. Farrar, 2691 NW. 106th Ave., Coral Springs, Fla. 33065

[21] Appl. No.: 969,537

[22] Filed: Dec. 14, 1978

[51] Int. Cl.[2] ..... G06G 7/60; G04B 47/06

[52] U.S. Cl. ..... 73/291; 58/145 R; 73/432 R; 364/418

[58] Field of Search ..... 73/291, 300, 432 R; 58/126 R, 145 R, 152 R; 364/418

[56] References Cited

U.S. PATENT DOCUMENTS

| | | | |
|---|---|---|---|
| 3,475,902 | 11/1969 | Wessel | 58/126 R |
| 3,505,808 | 4/1970 | Eschle | 58/126 R |
| 3,696,610 | 10/1972 | Charbonnier | 58/145 R |
| 4,054,783 | 10/1977 | Seireg et al. | 73/432 R X |
| 4,109,140 | 8/1978 | Etra | 58/145 R X |

*Primary Examiner*—Gerald Goldberg
*Assistant Examiner*—Joseph W. Roskos
*Attorney, Agent, or Firm*—Joseph Zallen

[57] ABSTRACT

The monitor has means for automatically initiating a counter which displays accumulated bottom time and surface interval and means for preventing resetting until a safe surface interval has elapsed.

7 Claims, 5 Drawing Figures

MONITOR FOR DIVERS TO AVOID DECOMPRESSION

BACKGROUND OF THE INVENTION

This invention relates to equipment for divers and in particular for scuba divers.

Divers have one eternal worry namely accumulating too much nitrogen in their blood. The United States Navy has developed tables which guide a diver as to when and how long he can safely be at a particular depth without having to go through a decompression stop. The tables also inform a diver how soon he can make a second or further dive. This is because there is nitrogen accumulation which must be dissipated.

An ordinary scuba diver finds it difficult to utilize the charts in his work. Devices that have been described which either mechanically or electrically store such information are to my knowledge, very elaborate, large and totally impractical.

There is a device marketed by Princton Techtronics of Hightstown, New Jersey entitled "Bottom Timer" which comprises a pressure-activated stop watch that sets the time in motion when an approximate depth of five to nine feet is obtained. The watch will continue to run recording the elapsed time until the activating depth is reached again. However, this device has to be manually reset before repetitive dive. Further the device gives no indication of the time spent on the surface or "surface interval time".

The variables required for correct interpretation of the United States Navy Dive Tables are maximum depth of dive, bottom time, repetitive diving group designation, surface interval time and residual nitrogen time. The Princton Techtronics device only measures bottom time and thus leaves open the danger of improper utilization of the tables.

Prior art which has been considered in the preparation of this patent application comprise the following United States and foreign patents: U.S. Pat. No. 3,111,003 A. Droz Nov. 19, 1963; U.S. Pat. No. 3,377,860 F. J. Masters Apr. 16, 1968; U.S. Pat. No. 3,475,902 P. Wessel Nov. 4, 1969; U.S. Pat. No. 3,505,808 U. A. Eschle Apr. 14, 1970; U.S. Pat. No. 3,696,610 Charbonnier Oct. 10, 1972; U.S. Pat. No. 3,759,101 Borom et al. Sept. 18, 1973; U.S. Pat. No. 3,910,117 Wicklund Oct. 7, 1975; U.S. Pat. No. 3,992,949 Edmondson Nov. 23, 1976; U.S. Pat. No. 4,054,783 Seireg et al. Oct. 18, 1977; Swiss Pat. No. 365,027 1962 German Pat. No. 1,236,418 1962.

The prior art has been concerned with the problems of a diver and described devices which are of some assistance. However, none of the prior art references provides automatic monitoring for the diver through successive dives to prevent the need for decompression. Thus U.S. Pat. No. 3,696,610 is primarily concerned with indicating the duration of decompression. U.S. Pat. No. 3,377,860 is a combination watch and depth gauge which does not record bottom time and ascent time for post-dive indication. U.S. Pat. No. 3,992,949 is a combination depth gauge, watch and rate of ascent computer which does not provide any direct reading of bottom time or maximum depth.

One object of the present invention is to provide a compact inexpensive light weight device which can be worn by the diver and which can automatically provide him continuously with the necessary guidance so as to avoid the necessity of decompression during the series of successive dives.

Other objects and advantages of this invention will be apparent from the description and claims which follow taken together with the appended drawings.

SUMMARY OF INVENTION

The invention comprises broadly a device having a display surface and which can be worn on the wrist of the diver. The device includes means for automatically initiating a counter which will continuously display the bottom time, means for shutting off but maintaining the display of the total elapsed bottom time once the diver has reached the surface again, and means for automatically counting and displaying the surface interval time after the diver has come to the surface. Means are also provided to prevent resetting until at least a safe time, as for example ten minutes, of surface interval time has elapsed. The diver does make reference to the appropriate tables in the United States Navy Table which reference is considerably simplified. The surface interval time keeps accumulating and the bottom time display remains fixed until the diver again descends through a selected point below the surface, as for example, five feet at which time the displays are reset to zero and the functions repeat.

In a variation of the invention, the display includes in addition to the elapsed bottom time and the surface interval, an indication of the maximum depth as defined for use with the tables. In this form of the invention it is also preferable to provide a series of bezels which when properly selected provides the diver with his no decompression limit.

SPECIFIC EXAMPLES OF INVENTION

Figure 1:
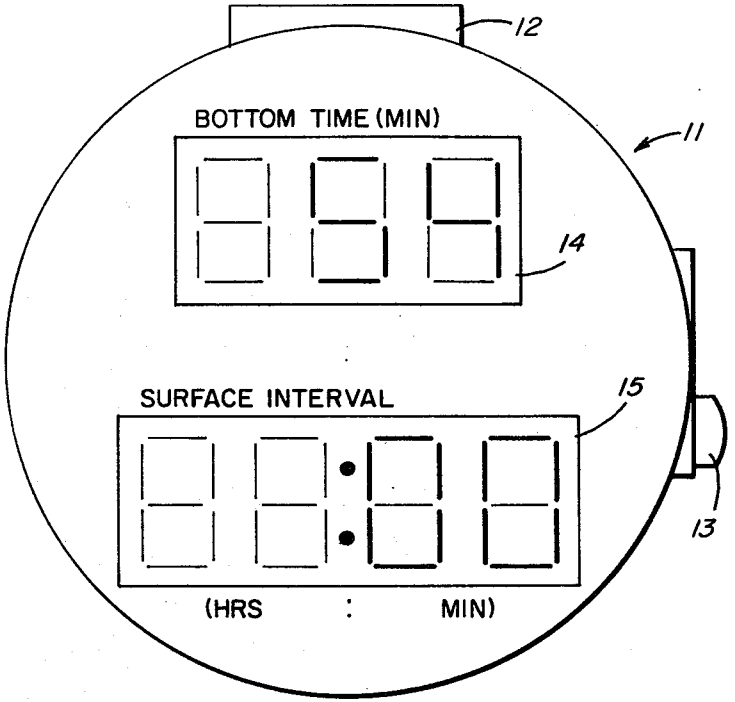
FIG. 1 is a plan view of the display of one form of the invention.
Figure 2:
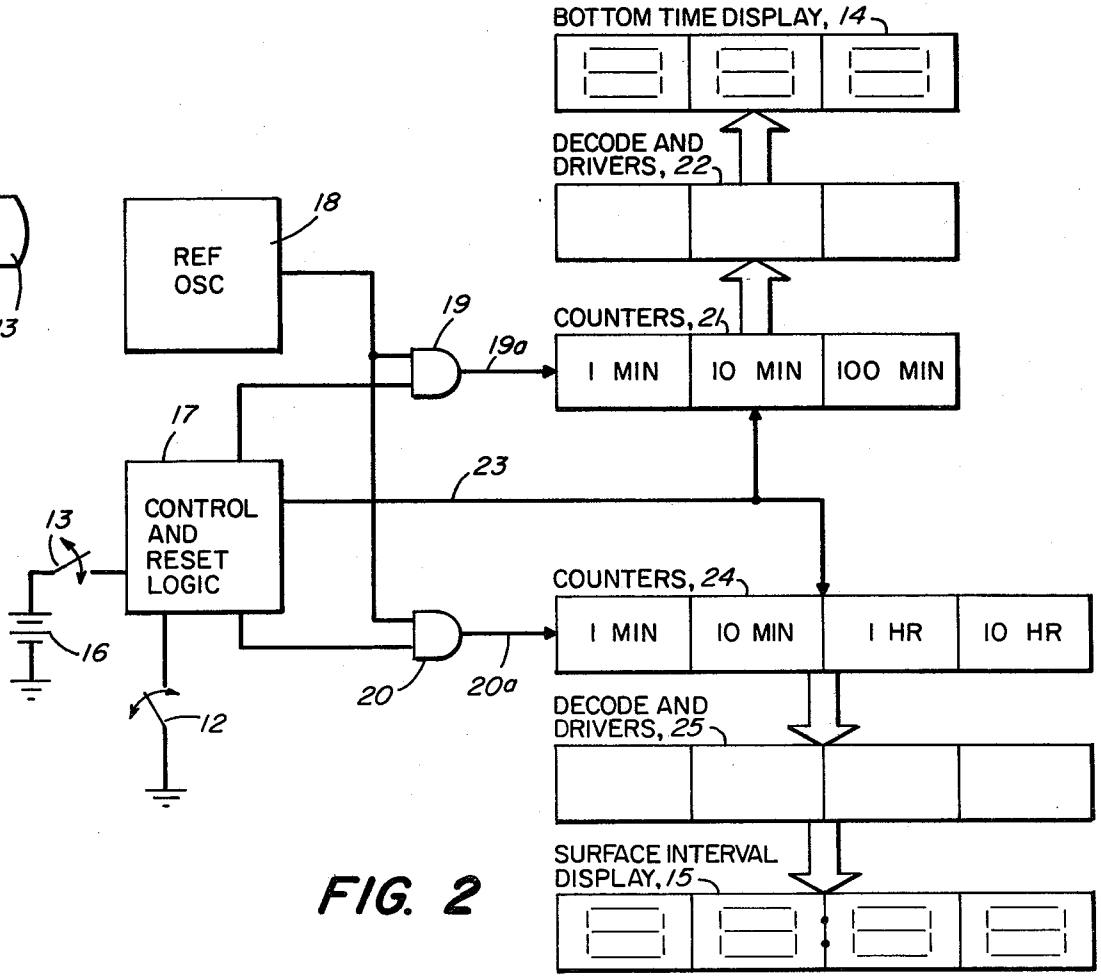
FIG. 2 is a block diagram of computer logic which can be used.
Figure 3:
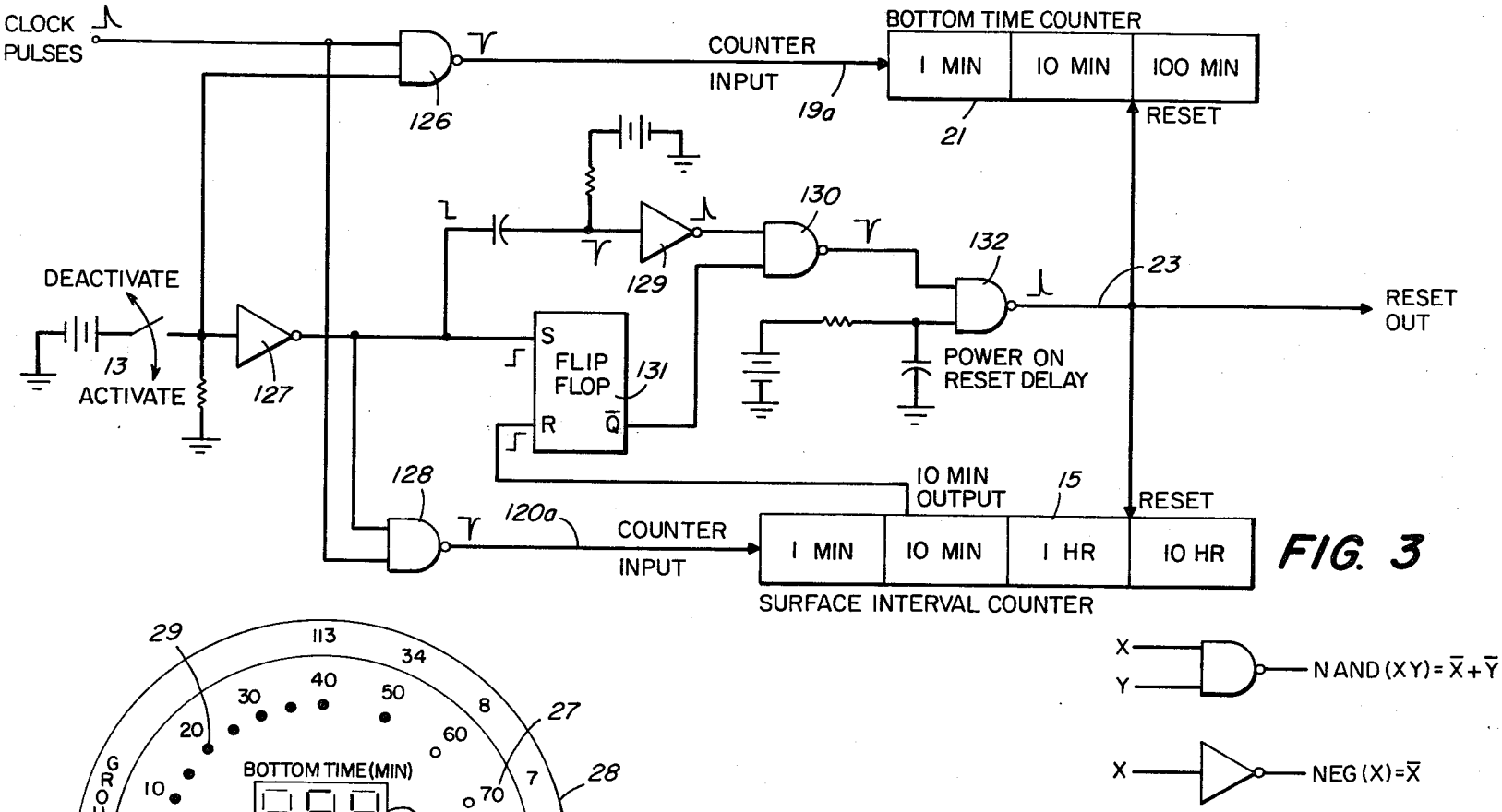
FIG. 3 is a logic diagram of the repetitive dive timer control and reset logic.

In the embodiment of the invention illustrated in FIGS. 1–3, the device 11, which would be of the order of the size of a wristwatch, has a display face which displays the bottom time 14 and the surface interval 15 digitally. There is an on/off switch 13 and a pressure switch 12.

As the diver prepares for the first dive of the day he switches on the unit with switch 13 thus turning on the bottom time display 14 and the surface interval display 15. The surface interval display colon would be pulsating at a selected rate, as for example one per second. The pressure switch 12 is so arranged that when the diver reaches five feet on his first dive descent the pressure switch is activated and both of the displays are reset to zero. By activation the bottom time display starts to accumulate while the surface interval display is held to zero. In this mode, the diver can at any time during the dive refer to the instrument to determine his bottom time. Upon returning to the five foot depth on his ascent at the end of the dive the pressure switch 12 deactivates which stops the accumulation of time in the bottom time display 14, but also starts the accumulation of time in the surface interval display 15. The instrument is so arranged that the timer cannot be reset until at least ten minutes have accumulated in the surface interval display, because this is stated to be required by the United States Navy Repetitive Dive Tables. By use of the proper tables, the surface interval time displayed, and the bottom time displayed the diver can safely determine when he can dive again to what depth and for how long.

As illustrated in FIG. 2 the battery 16 which is allowed to power the circuit by switch 13 is fed to the control and reset logic unit 17. Unit 17 is also controlled by the action of the pressure switch 12 and also connects to independent counters 21 and 24. Each of the counters has decode and driver circuits, 22 and 25. Reference oscillator 18 is used with counter inputs 19 and 20.

Figure 4:
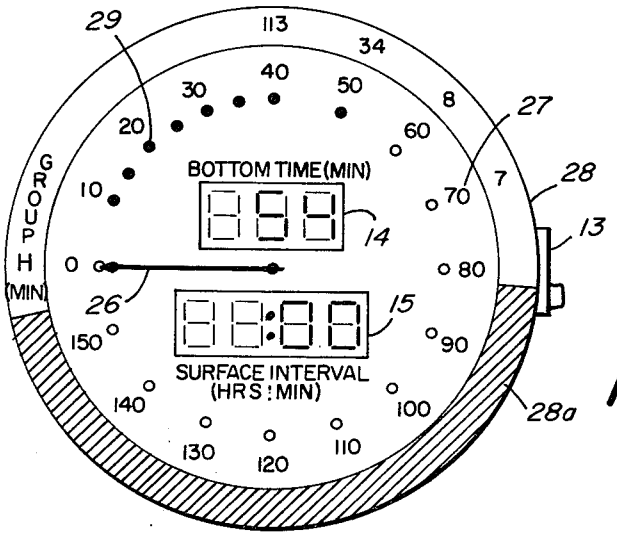
FIG. 4 is a plan view of the display of a second form of this invention.
Figure 5:
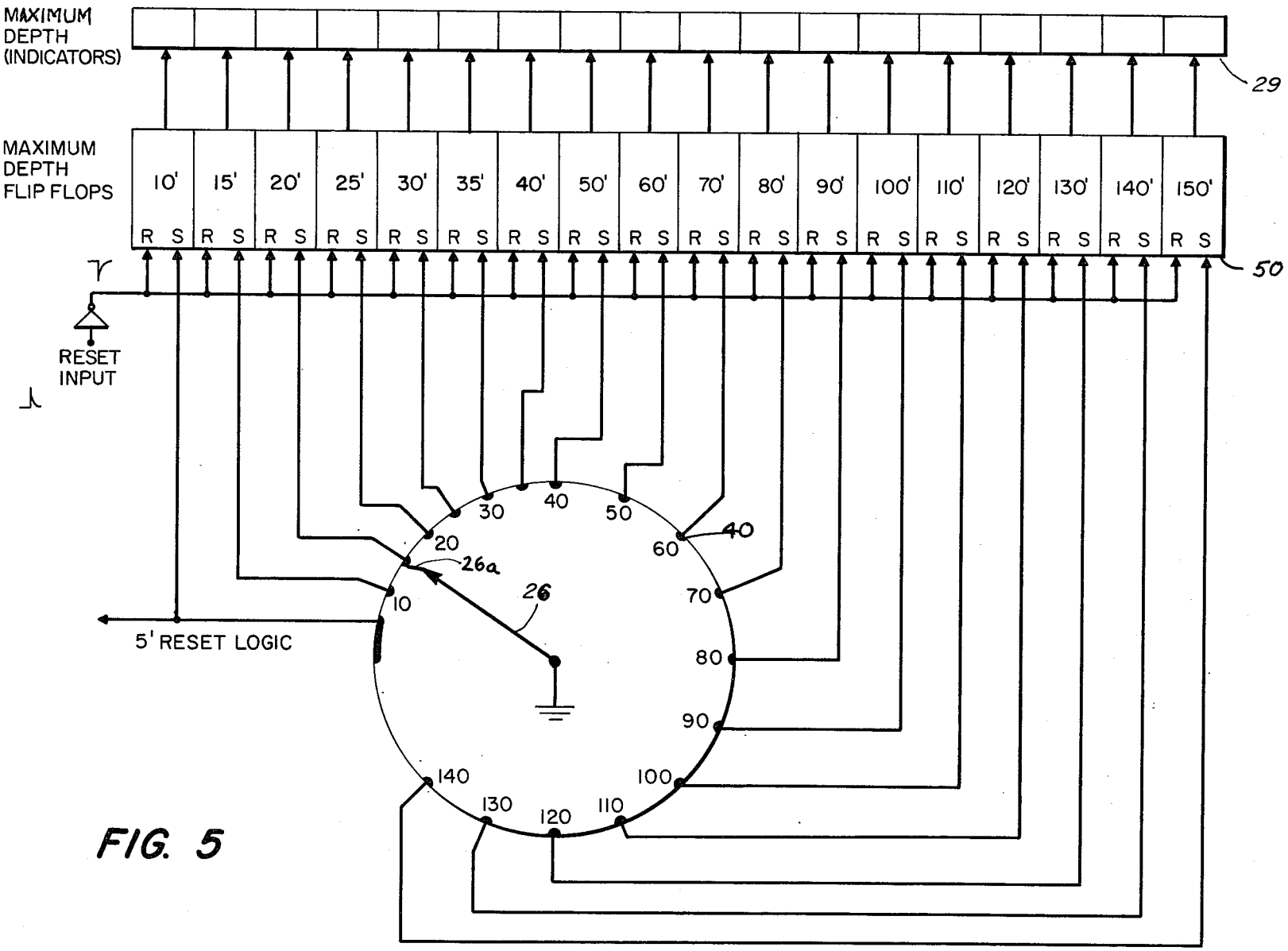
FIG. 5 is a diagram of the maximum depth indicator control logic associated with the display of FIG. 4.

In the embodiment illustrated in FIGS. 4 and 5 the display includes the bottom time display 14 and the surface interval display 15 but has in addition a series of lights 29, a dial marking 27 and a dial needle 26. The dial needle denotes the depth and the lights are so arranged as to show at all times the maximum depth reached. The bezel 28 is selected according to the tables and gives the diver the necessary information as to the safe bottom time that is permissible.

Referring now more specifically to the example illustrated in FIGS. 1, 2 and 3, the pressure switch 12 is the function input to the control and reset logic 17 which indicates whether the diver is on the surface or submerged. Control and reset logic 17 controls the operation of and resets through line 23 the time counters 21, 24 as a result of the inputs from switch 13 and pressure switch 12. Reference oscillator 18 is the time reference (clock pulses) for the system. Counters 21, 24 are the time reference accumulators for the bottom time and surface interval. Counter inputs 19, 20, are gates which act as control elements to either apply or deny entrance of the pulses to the counters. These gates are controlled by the control and reset logic.

As the diver descends through five feet, the pressure switch 13 activates and applies the battery high voltage to the inputs of gate 126 and inverter 127. With the input of gate 126 being high, the clock (reference oscillator) pulses are allowed to pass and are applied to the input of the bottom time counter 21 for accumulation. As the input to the inverter 127 goes high, its output goes low. The low output from inverter 127 is applied to gate 128 which stops passage of the clock pulses to the surface interval counter. The output of inverter 127 is also applied to the set input of flip flop 131, but does not cause any change in state of the flip flop during a high to low change. The negative going output of inverter 127 is also differentiated by an RC circuit and applied to inverter 129. This differentiated input to inverter 129 causes the inverter to generate a positive pulse in time coincidence with the falling output of inverter 127 and the activation of pressure switch 13. The positive pulse output of inverter 129 is applied to gate 130 which is enabled to pass and invert the pulse due to a high output from the $\bar{Q}$ output of the unset flip flop 131. The negative pulse output from gate 130 is applied to the input to gate 132. If the battery power to the device has been on, the RC timing circuit at the other input to gate 132 enables the negative pulse from gate 130 to be passed and inverted by gate 132. The positive output pulse from gate 132 is applied to and resets both the bottom time and surface interval counters. Therefore, it can be seen that, if the flip flop has not been set, the activation of the pressure switch passes through inverters and gates 127, 129, 130 and 132 and resets the counters. The activation of the switch also causes clock pulses to be applied to the bottom time counter 21 and denied to the surface interval counter 15.

The RC timing circuit on the second input to gate 132 is a power on reset delay circuit. When power is first applied, the capacitor holds the input low until it is charged through the resistor. This holds the output of gate 132 high, resetting the counters, until the capacitor has charged to a high state. This then enables the gate for passage of pulses from gate 130.

As the diver ascends through five feet, the pressure switch 13 deactivates, which causes the inputs to gate 126 and inverter 127 to go low. The input to gate 126 being low stops the passage of clock pulses to the bottom time counter 21. This means that the bottom time counter will contain and display the total submerged time (bottom time and ascent time) for the dive. When the input to inverter 127 goes low, its output changes from a low to a high state. This output change of inverter 127 which is applied to the set input of the flip flop causes the flip flop to change states with $\bar{Q}$ going low. The low $\bar{Q}$ output of the flip flop disables gate 130 which stops any further counter resets due to pressure switch activation until the flip flop 131 has been reset. The output of inverter 127 being high also enables gate 128 which allows passage and accumulation of clock pulses by the surface interval counter 15. After the surface interval counter has accumulated ten minutes of clock pulses its ten-minute output will go high. This output is applied to the reset input to flip flop 131 which resets the flip flop's $\bar{Q}$ output high enabling gate 130 for passage of a reset pulse on the next activation of the pressure switch. The surface interval counter 15 will continue to accumulate and display surface time until the pressure switch is again activated.

In the embodiment illustrated in FIGS. 4 and 5, the additional information, namely the series of lights denoting maximum depth, dial marking and needle denoting the depth, are provided by the motion of the depth gauge pointer as it moves around the face of the dial. The depth gauge pointer **26*a* is at ground potential and as it moves contacts and grounds the conducting strips located on the circumference of the housing. These conductive strips designated as numeral 40 in FIG. 5 are located in angular correspondence with the indicated depth reading. Each of the strips grounded by the pointer is used as a set input to a maximum depth flip flop 50. When the set input to a particular flip flop is grounded by the pointer its output drives the particular maximum depth indicator 29**.

Each corresponding depth conductive strip 40 sets the next tabulated maximum depth indicator 29. This operation is consistent with the Navy tables which require the person to "enter the table on the exact or next greater depth."

From a depth of zero to five feet there is a conductive strip which takes the place of the pressure switch as a logic input to the control and reset logic. As the diver descends and the depth gauge pointer **26*a* rotates, corresponding maximum depth indicators 29 will illuminate and stay illuminated until the maximum depth flip flops 50** receive a reset input from the control and reset logic. This happens when the diver again descends after a surface interval of greater than ten minutes.

There is a replaceable bezel on the device. The bezel 28 is selected by the diver in accordance with the recommendations of the United States Navy Dive Tables relating to repetitive dives. The purpose of the bezel is to tell the diver his maximum bottom time to avoid the necessity of decompression. Thus, as illustrated in FIG. 4 the bezel 28 is for "Group H" in the tables. It shows that at a maximum depth of fifty feet, the permitted bottom time would be 34 minutes which would decrease to 7 minutes at a maximum depth of 70 feet.

The movable needle 26 can be part of a conventional depth gauge except it is modified to have a wiper 26*a* to engage the contacts 40 which lead to the digital switches (flip-flops) 50. Since the needle 26 is grounded as it moves in its circular pattern it successively energizes the flip-flops for increasing depth, which in turn illuminate the depth indicators 29. This energization and illumination remains until there is a reset signal. The contacts 40 can be a circular array of vertical conductive strips.

In using this second embodiment of the invention the diver uses his bottom time minus his ascent time, the maximum depth and the surface interval time to determine the appropriate bezel for his next dive. The maximum depth digital switches and indicators remain energized until on the next dive there is resetting of the bottom time and surface interval time displays. The maximum depth indicators are deenergized and reset at the same time.

I claim:

1. A monitor device to be worn by a diver and characterized as automatically providing and maintaining information in display form of the submerged time and elapsed surface interval time, comprising:

(a) switch means;

(b) means for activating said switch means (a) at a predetermined depth;

(c) means for accumulating and displaying submerged time;

(d) means for accumulating and displaying surface interval time;

(e) means for resetting submerged time (c) and surface interval time (d) displays to zero;

(f) means for stopping accumulation but maintaining display in said submerged time means (c) while starting accumulation and display in said surface interval time means (d) when the diver rises above said predetermined depth;

(g) means for maintaining the accumulation and display of the surface interval time (d) until the diver descends again to said predetermined depth; and (h) means for preventing actuation of said resetting means (e) until there has been a minimum predetermined surface interval time.

2. The monitor device of claim 1 which includes a display of maximum depth.

3. The monitor device of claim 2 which includes a replaceable bezel; said bezel containing the recommended no decompression time limits which register with the maximum depth display.

4. A monitor device to be worn by a diver and characterized as automatically providing and maintaining information in display form of the submerged time and elapsed surface interval time, comprising:

(a) switch means;

(b) means for activating said switch means (a) at a predetermined depth;

(c) means for accumulating and displaying submerged time;

(d) means for accumulating and displaying surface interval time;

(e) means for resetting submerged time (c) and surface interval time (d) displays to zero;

(f) means for stopping accumulation but maintaining display in said submerged time means (c) while starting accumulation and display in said surface interval time means (d) when the diver rises above said predetermined depth; and (g) means for maintaining the accumulation and display of the surface interval time (d) until the diver descends again to said predetermined depth; said device including means having a movable member responsive to change in depth and a plurality of depth indication display means; each said display means having switch means cooperable with said member.

5. The monitor device of claim 4 wherein the member rotates in a circular pattern and said depth display means comprise a plurality of spaced conductive strips arranged in a circular pattern so that the wiping of said member on a said strip energizes a display means.

6. The monitor device of claim 5 wherein said display means comprises a digital switching means connected to a display.

7. The monitor device of claim 6 wherein said digital switching means remain on so that the displays remain on until there is a reset signal.

* * * * *